US010145121B1

(12) United States Patent
Devitt

(10) Patent No.: US 10,145,121 B1
(45) Date of Patent: Dec. 4, 2018

(54) CANOPY

(71) Applicant: Jon W. Devitt, Ida Grove, IA (US)

(72) Inventor: Jon W. Devitt, Ida Grove, IA (US)

(73) Assignee: MIDWEST INDUSTRIES, INC., Ida Grove, IA (US)

( * ) Notice: Subject to any disclaimer, the term of this patent is extended or adjusted under 35 U.S.C. 154(b) by 0 days.

(21) Appl. No.: 15/610,952

(22) Filed: Jun. 1, 2017

(51) Int. Cl.
*E04F 10/06* (2006.01)

(52) U.S. Cl.
CPC ..... *E04F 10/0607* (2013.01); *E04F 10/0614* (2013.01); *E04F 10/0633* (2013.01); *E04F 10/0648* (2013.01); *E04F 10/0659* (2013.01); *E04F 10/0662* (2013.01)

(58) Field of Classification Search
CPC ..... E04F 10/0607; E04F 10/0614; E04F 10/0633; E04F 10/0648; E04F 10/0659; E04F 10/0662; A01G 9/227
See application file for complete search history.

(56) References Cited

U.S. PATENT DOCUMENTS 4,091,584 A * 5/1978 Brown ..... A01G 9/16 135/127
4,192,112 A * 3/1980 Reilly, Sr. ..... E04F 10/02 160/46
4,657,062 A * 4/1987 Tuerk ..... B60J 7/104 160/243
4,706,420 A 11/1987 Winkler
4,836,264 A * 6/1989 Machin ..... E06B 9/17 160/120
4,920,714 A * 5/1990 Sease ..... B44C 7/022 160/392
5,038,517 A 8/1991 Talbott
5,186,231 A * 2/1993 Lewis ..... B60J 7/068 160/264
5,564,234 A 10/1996 Vermeulen
5,613,543 A * 3/1997 Walton ..... E04G 5/12 135/119
7,621,581 B2 11/2009 Wiegel et al.
7,814,727 B2 * 10/2010 LaCasse ..... E04B 1/0046 52/222
7,972,099 B2 * 7/2011 Leggett ..... B60P 7/0861 410/100
8,051,868 B2 * 11/2011 Whitlow ..... E04H 15/644 135/120.3
2008/0231069 A1 9/2008 Petelka
2010/0264246 A1 7/2010 Schaefer

* cited by examiner

*Primary Examiner* — Babajide A Demuren
(74) *Attorney, Agent, or Firm* — Sturm & Fix LLP

(57) ABSTRACT

A canopy including a flexible cover and a framework. The cover carries two rods, one secured to each of the opposite sides of the cover. Each of the rods has a gear attached to each of its ends. Brackets attached to the four corners of the framework each include a socket sized to receive the rod end, and, also, each bracket includes a pawl. When the rod is positioned in the socket, the gear on the rod is aligned with the pawl on the bracket to complete a ratchet tensioning mechanism that can be operated to progressively tighten the cover over the framework. To install the cover, the cover is rolled up on the rods and placed on the framework. The cover is then unrolled from the rods towards opposite sides of the framework where the rods are secured in the bracket sockets, tightened by the ratchet mechanisms, and secured by a locking pin. The operation is simply reversed when the cover is to be stored on top of the framework, or removed for storage elsewhere.

9 Claims, 9 Drawing Sheets

CANOPY

BACKGROUND OF THE INVENTION

Field of the Invention

The present invention relates to the field of canopies, and more particularly to a canopy cover, and a method of selectively attaching the canopy cover to a framework.

Canopies are well known and used in many forms to provide shelter from the sun or rain. Canopies with flexible covers made of fabric or vinyl are used in certain applications where it is necessary to install and remove the cover periodically. For example, canopies for boat shelters are generally removed in the off season and folded for storage. Also, in coastal regions, removal of the canopy cover is required when a storm is predicted.

As can been by reference to the following U.S. Pat. Nos. 4,706,420, 5,038,517, 5,564,234, 7,621,581, 20080231069, 20100164246 the prior art is replete with myriad and diverse canopy constructions.

While all of the aforementioned prior art constructions are adequate for the basic purpose and function for which they have been specifically designed, they are uniformly deficient with respect to their failure to provide a simple, efficient, and practical canopy cover, and a method of installing a canopy cover on a framework.

As a consequence of the foregoing situation, there has existed a longstanding need for a new and improved canopy and the provision of such a construction is a stated objective of the present invention.

BRIEF SUMMARY OF THE INVENTION

Briefly stated, the present invention provides a canopy including a flexible cover and a framework. The cover carries two rods, one secured to each of the opposite sides of the cover. Each of the rods has a gear attached to each of its ends. Brackets attached to the four corners of the framework each include a socket sized to receive the rod end, and each bracket also includes a pawl. When the rod is positioned in the socket, the gear on the rod is aligned with the pawl on the bracket to complete a ratchet tensioning mechanism that can be operated to progressively tighten the cover over the framework. To install the cover, the cover is rolled up on the rods and placed on the framework. The cover is then unrolled from the rods towards opposite sides of the framework where the rods are secured in the bracket sockets, tightened by the ratchet mechanisms, and secured by a locking pin. The operation is simply reversed when the cover is to be stored on top of the framework, or removed for storage elsewhere.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings wherein.

DETAILED DESCRIPTION OF THE INVENTION

Figure 1:
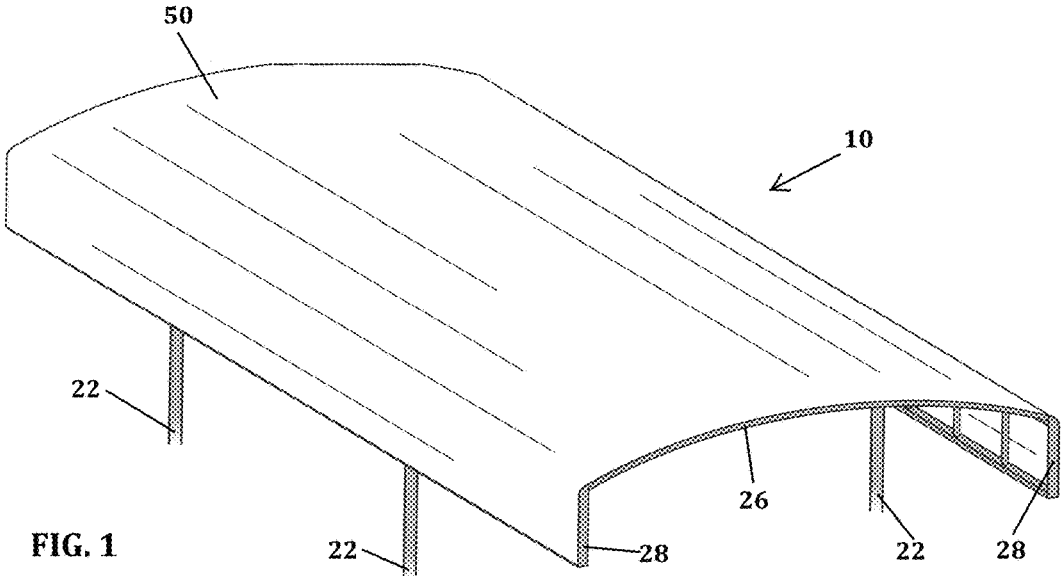
FIG. 1 is a perspective view of the canopy of the present invention with the cover installed.

As can be seen by reference to the drawings, and in particularly for FIG. 1, the canopy that forms the basis of the present invention is designated generally by the reference number 10.

Figure 6:
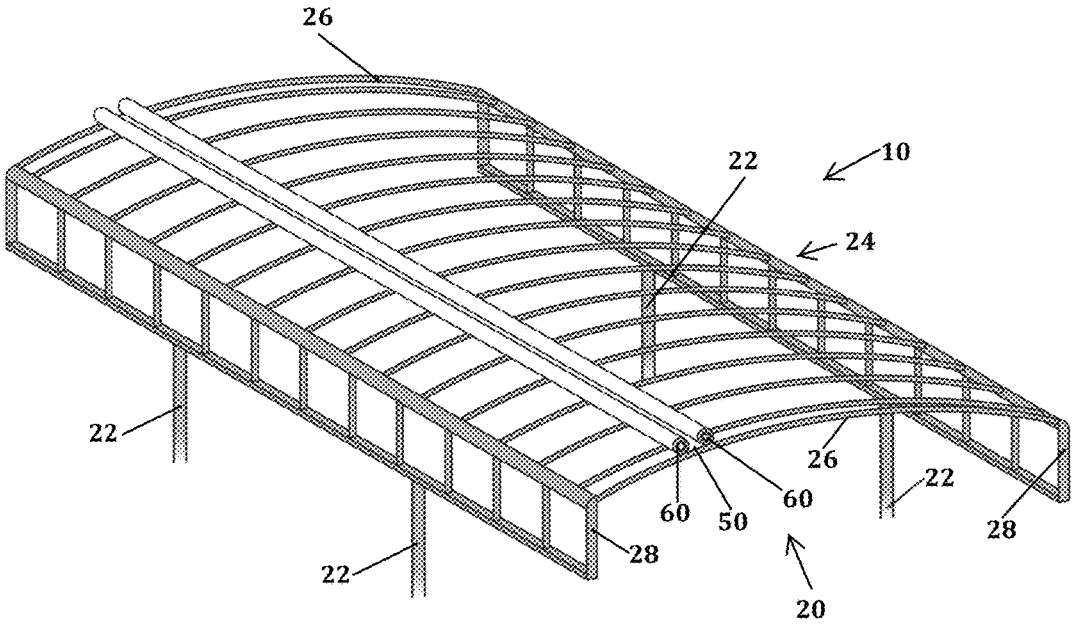
FIG. 6 is a perspective view similar to FIG. 5, but showing the cover completely rolled up on to the rods, with the rolls positioned on the canopy framework adjacent each other.

The canopy 10 includes a framework 20 having base supports 22 and a top covering support 24 suspended above the base supports 22. For example, in FIG. 6, the top support 24 is formed of a series of spaced arched beams 26 with downwardly directed valances 28 at opposite sides. The lower corners of the valances 28 each carry a bracket 30.

Figure 2:
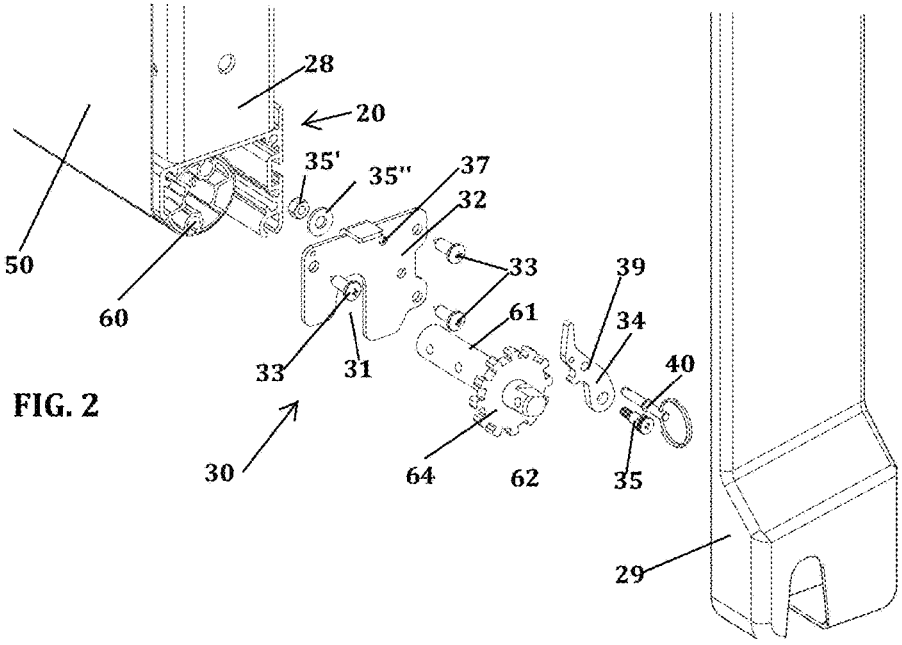
FIG. 2 is an exploded perspective view showing the bracket components that are attached to each of the four corners of the canopy framework, including the rod end that carries the gear that is selectively aligned with the pawl on the bracket to complete the ratchet tensioning mechanism.

As best shown in FIG. 2, each of the brackets 30, includes and plate 32 having a socket 31. Each plate 32 is attached to the framework 20 by fasteners 33, and a pawl 34 is attached to the plate 32 by fasteners 35, 35, 35". The plate 32 and the pawl 34 have openings 37 and 39, respectively, that can be aligned to receive a locking pin 40. A protective shield 29 encloses each bracket 30.

Figure 3:
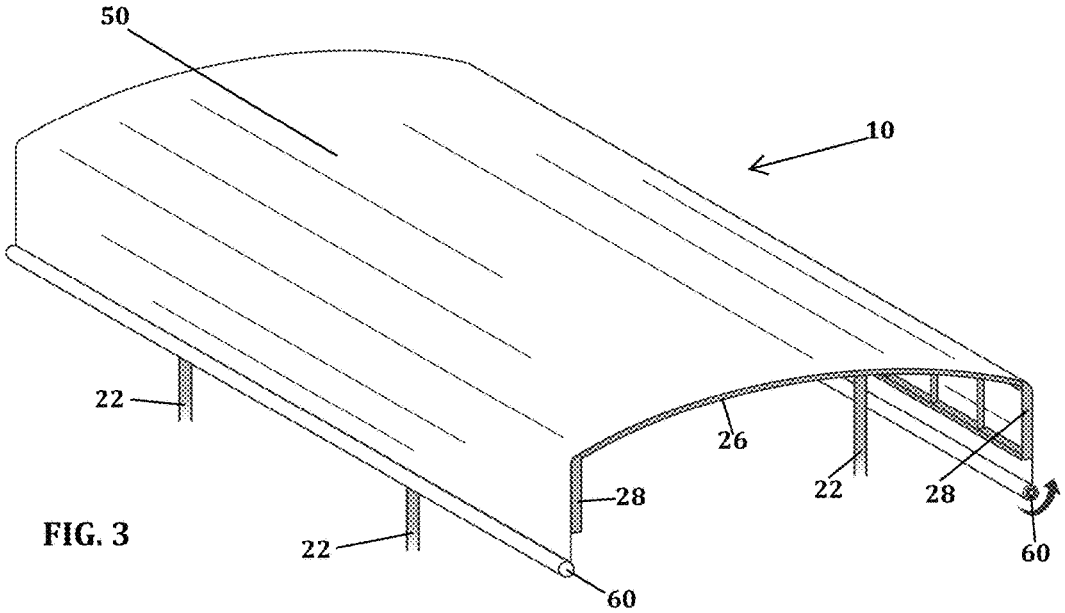
FIG. 3 is a perspective view similar to FIG. 1, but showing the rods at opposing sides of the canopy released from the brackets and extending down from the framework.
Figure 4:
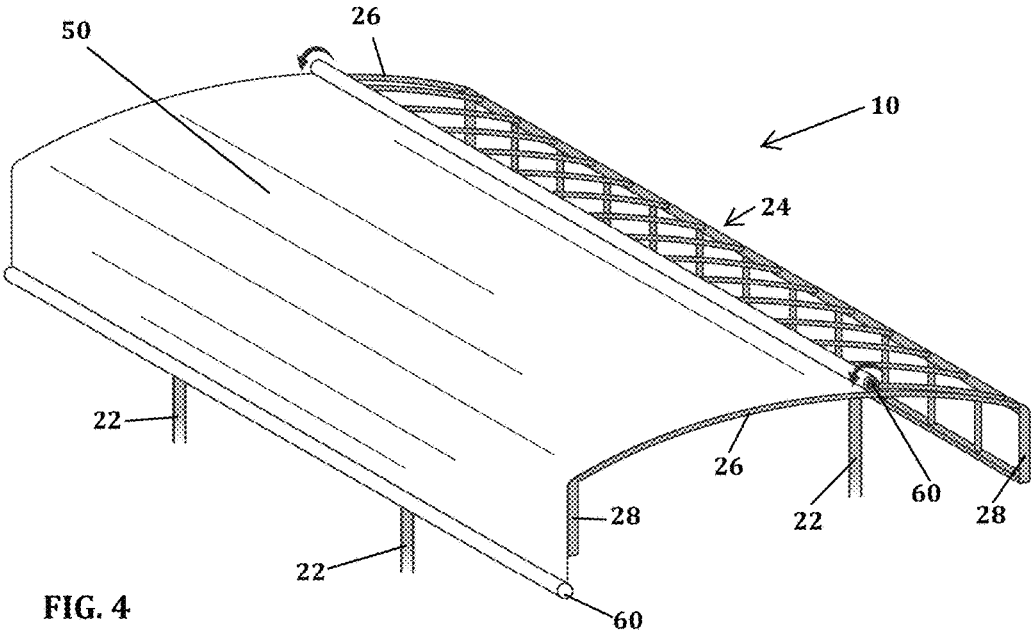
FIG. 4 is a perspective view similar to FIG. 3, but showing the cover rolled onto the rod as it is moved over the canopy framework.
Figure 5:
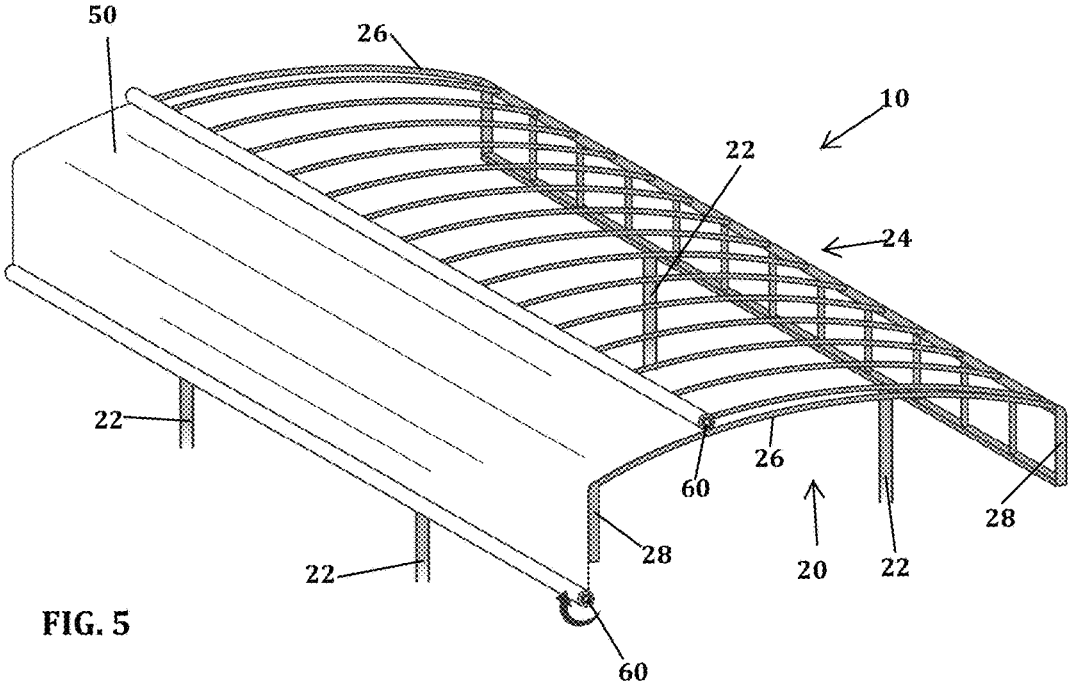
FIG. 5 is a perspective view similar to FIG. 4, but showing the cover rolled onto the rod and positioned about three-fourths of the way across the canopy framework, and showing the other released rod as it is first being rotated to roll up the cover.

A cover 50 is sized to extend over the top covering support 24 down past the lower corners of the valances 28 (FIG. 3). The opposite lower portions of the cover 50 extending down from the valances each have an attached rod 60 on which the cover 50 can be rolled up.

Figure 18:
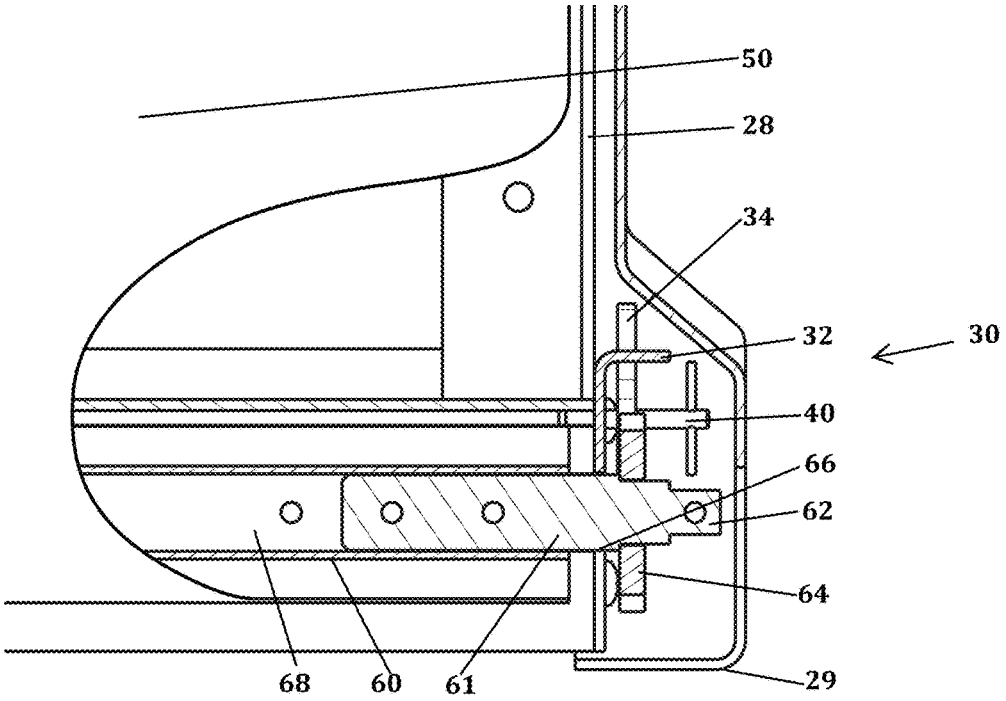
FIG. 18 is a partial side elevation sectional view with a portion cut away to show the stub shaft that forms the end of the rod with the attached gear, and the bracket components enclosed by a protective shield.

As best shown on in FIG. 18, each rod 60 has a flattened surface 62 at the outermost end to receive a tightening tool, such as a crank. A gear 64 is carried on the stub shaft 61 at the end of the rod 60 in from the flattened surface 62, and a surface 66 disposed in from the gears 64 is adapted to be selectively received in the socket 31 of the plate 32. The cover 50 is attached to an intermediate portion 68 of the rods 60.

Figure 16:
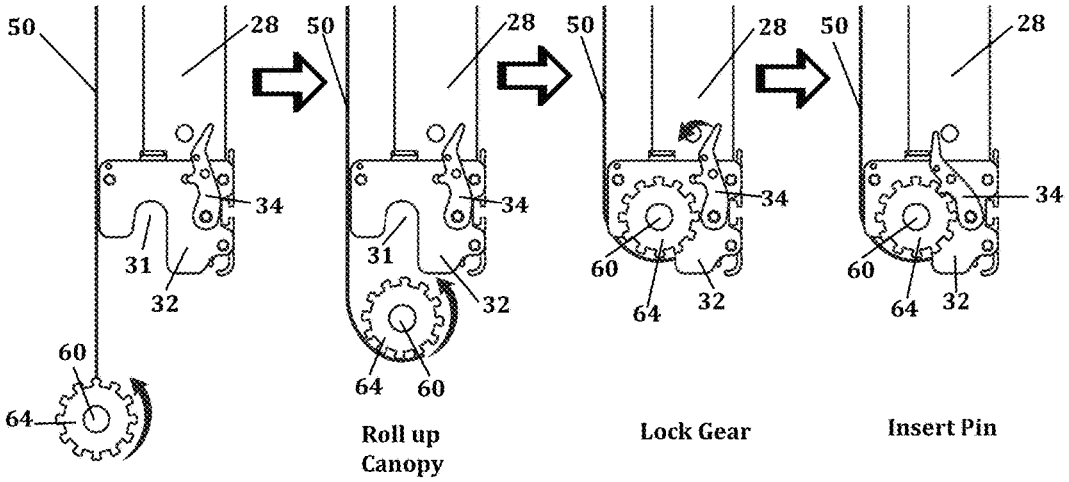
FIG. 16 is a series of partial side elevational views, illustrating the rod being rotated to roll the cover onto the rod, then being raised toward the bracket as it is rotated until it is completely raised to engage the socket of the bracket to align the gear on the rod with the pawl on the bracket to complete the ratchet tensioning mechanism, where the pawl of the ratchet is positioned to receive the locking pin.
Figure 14:
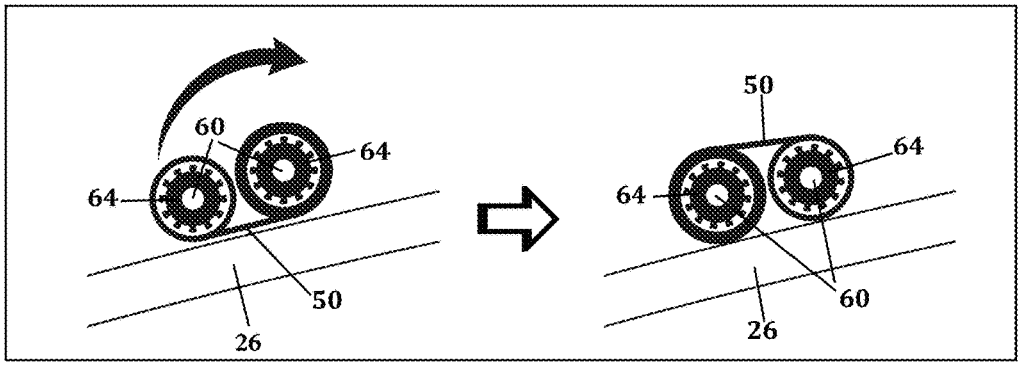
FIG. 14 is a pair of partial side elevational views showing the rods on the canopy framework, as in FIGS. 6-8, where one of the rods is being moved over the other to position the bottom of the cover up, so the rolls are restrained from movement.
Figure 15:
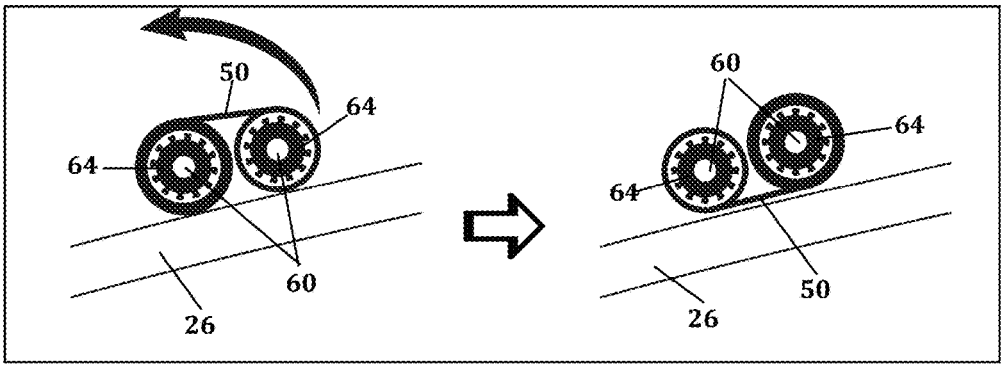
FIG. 15 is a pair of partial side elevational views similar to FIG. 14, but showing the rods on the canopy framework, as in FIGS. 9-10, where one of the rods is being moved over the other to position the bottom of the cover down, so it can be unrolled from the rods.
Figure 17:
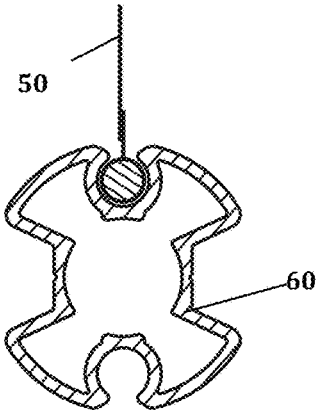
FIG. 17 is a sectional view showing the attachment of the cover to the rod.

FIG. 16 illustrates the sequence of operations performed to bring the rod 60 into contact with the bracket 30. Rotation of the rod 60 rolls the cover 50 onto the rod 60, and raises the rod 60 toward the socket 31 in the plate 32. When the rod 60 reaches the socket 31, the gear 64 on the rod 60 and the pawl 34 on the bracket 30 are aligned to complete a ratchet tightening mechanism. Continued rotation of the rod 60 acts to tighten the cover 50 over the framework to the degree desired, and the pin 40 is inserted to lock the cover 50 onto the framework 20.

Figure 7:
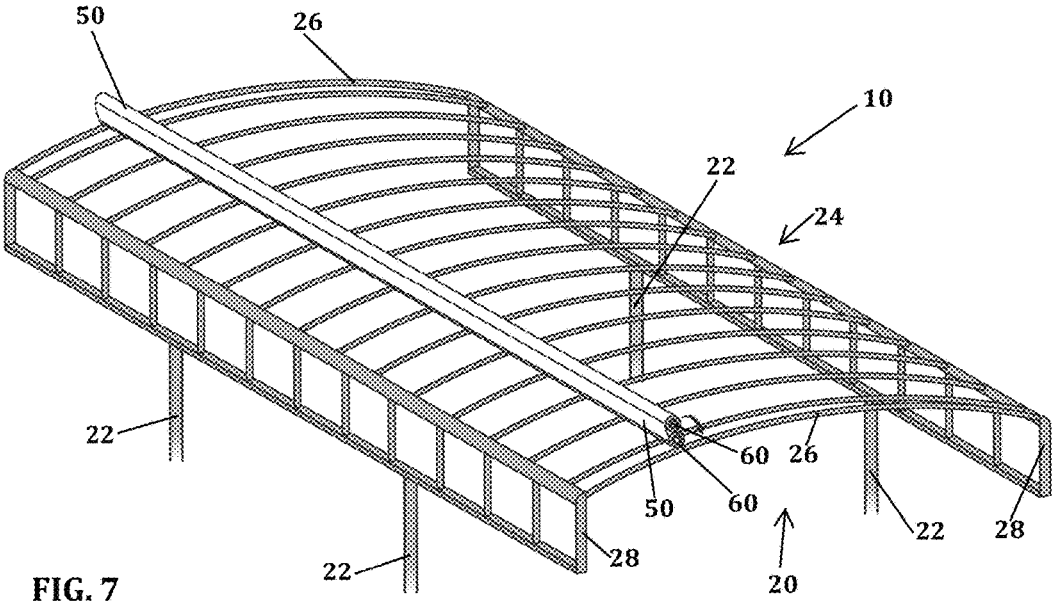
FIG. 7 is a perspective view similar to FIG. 6, but showing one of the rolls as it is being moved over to the opposite side of the other roll.
Figure 8:
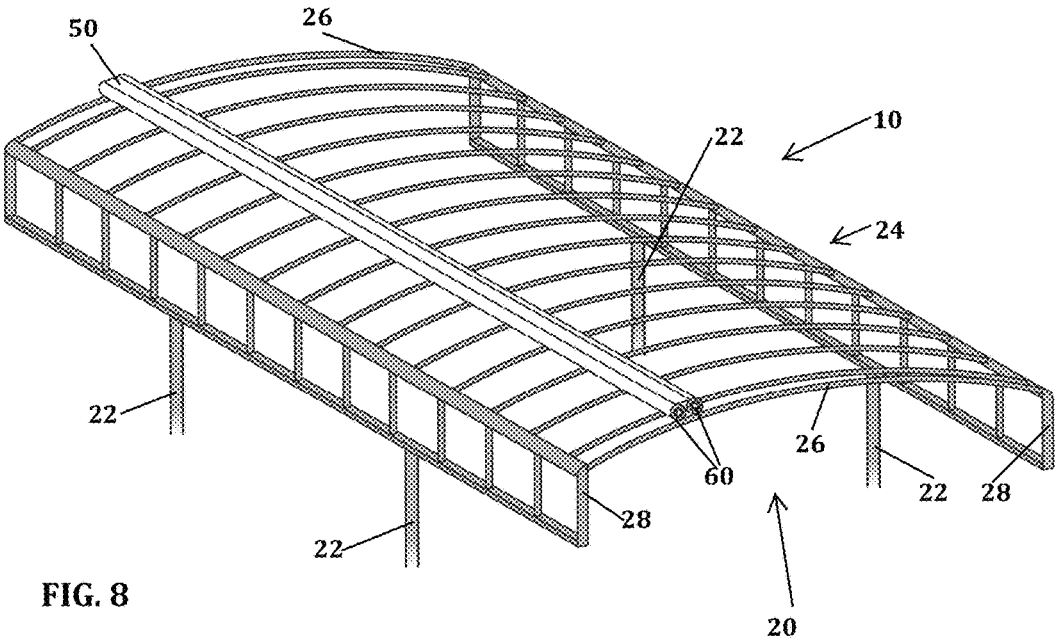
FIG. 8 is a perspective view similar to FIG. 7, but showing one roll moved to the opposite side of the other with the underside of the cover facing up to prevent the rods from moving, so it can be stored on top of the framework.
Figure 9:
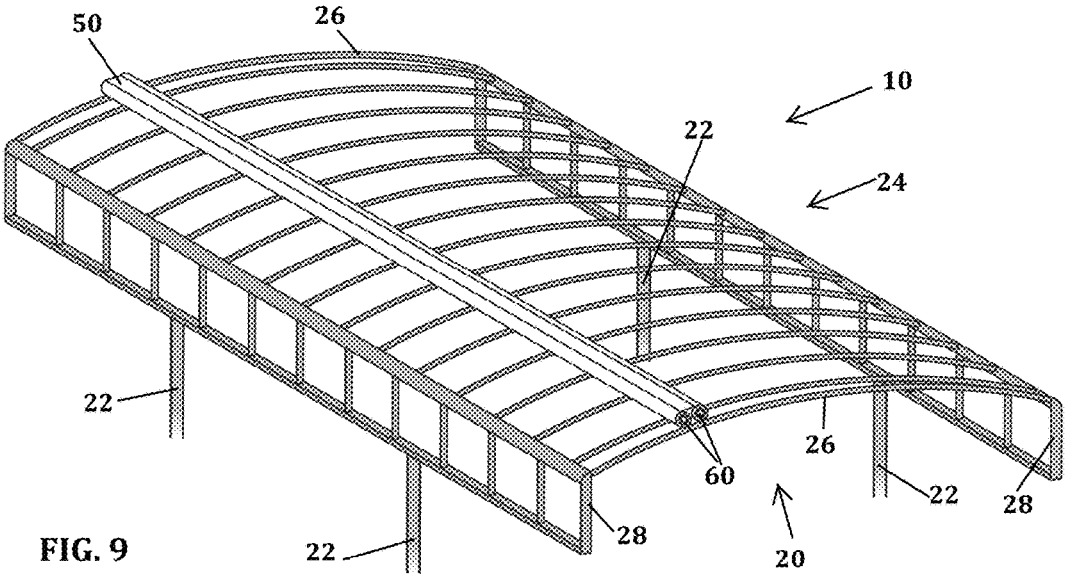
FIG. 9 is a perspective view identical to FIG. 8, illustrating the starting point for unrolling the cover from the storage position.
Figure 10:
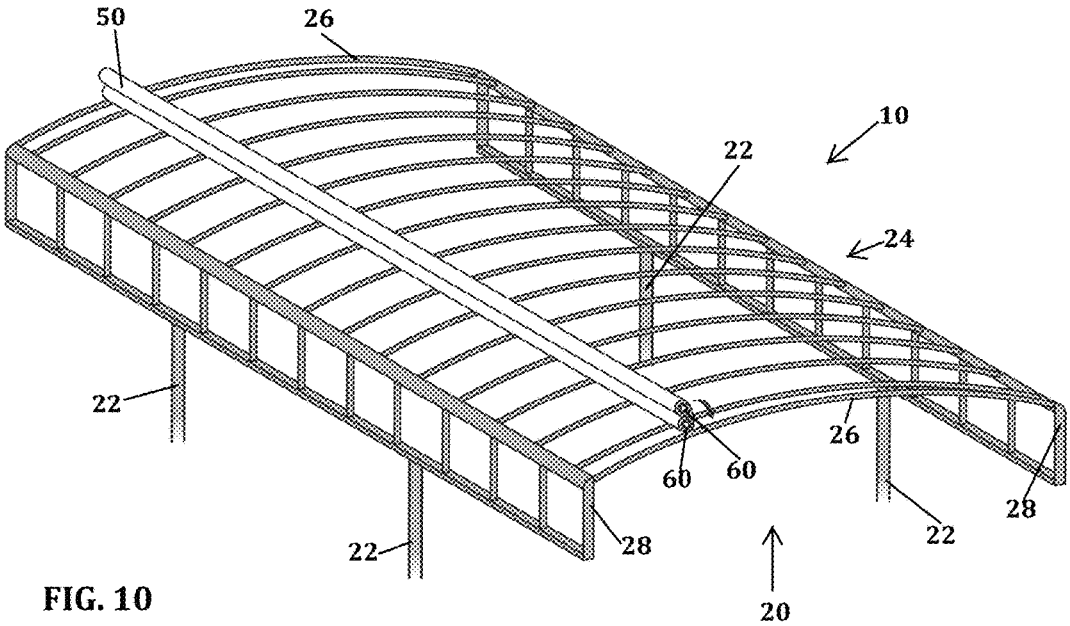
FIG. 10 is a perspective view similar to FIG. 9, but showing one of the rolls being moved over the other from the storage position.
Figure 11:
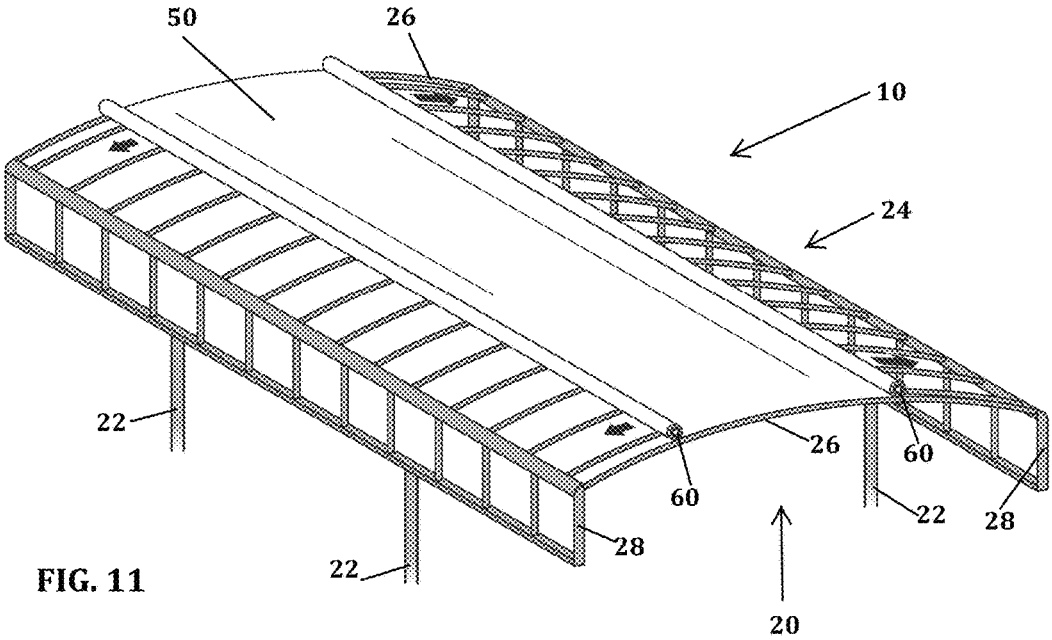
FIG. 11 is a perspective view similar to FIG. 10, but showing the cover being unrolled to opposite sides of the canopy framework.
Figure 12:
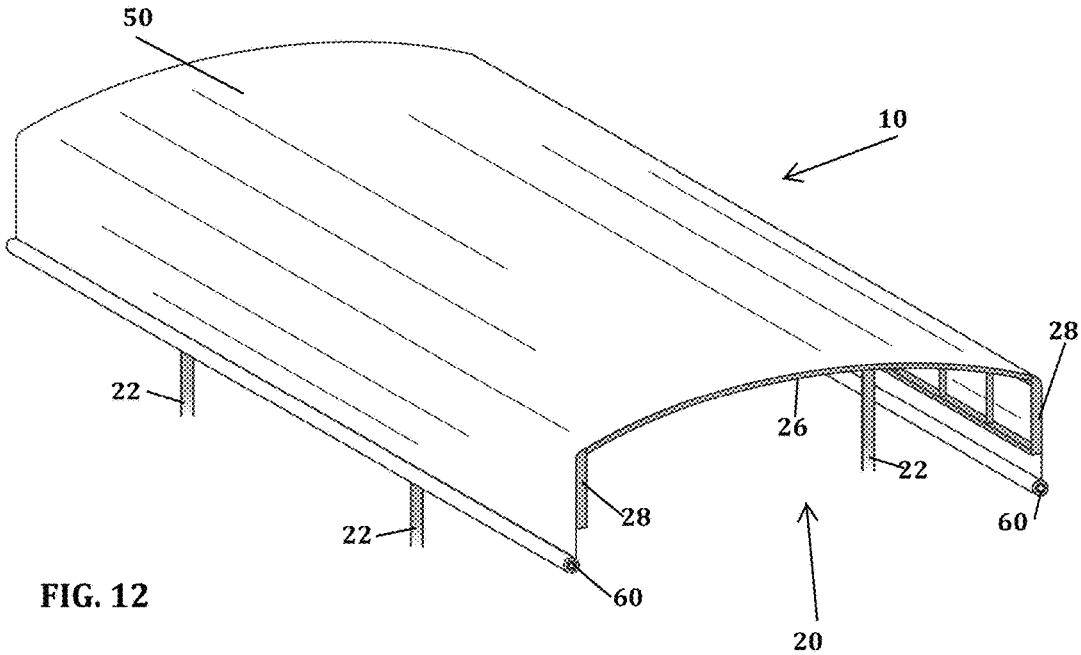
FIG. 12 is a perspective view similar to FIG. 11, but showing the cover completely unrolled from the rods and positioned to be secured to the brackets.
Figure 13:
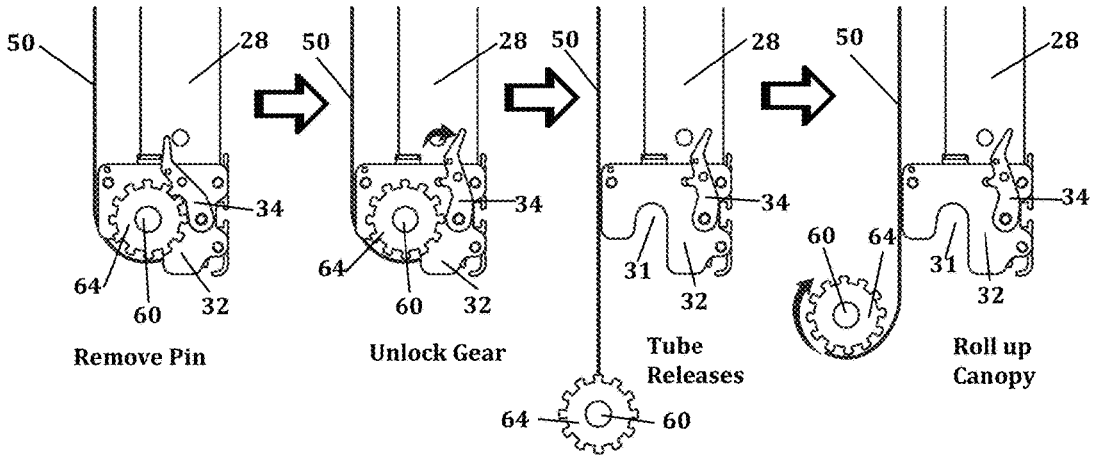
FIG. 13 is a series of partial side elevational views illustrating the rod being released from the bracket by removing the locking pin, moving the pawl out of engagement with the gear, rotating the rod to completely unroll the cover, and then rotating the rod in the opposite direction to roll the cover on the rod.

The method of removing the cover 50 from the framework 20 is illustrated in FIGS. 3-8 and 13-14, and the method of installing the cover 50 is illustrated in FIGS. 9-12 and 15-16. To install the cover 50, the cover 50 is rolled up on the rods 60 and placed on the framework top covering support 24. The cover 50 is then unrolled from the rods 60 towards opposite sides of the framework where the rods 60 are secured in the bracket sockets 31, tightened by the ratchet mechanisms, and secured by the locking pins 40. The operation is simply reversed when the cover 50 is to be removed. It is to be understood that the cover 50 may be left on and attached to the framework 20 for storage as shown in FIG. 7, or completely removed from the framework 20 to be stored at another location.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

The invention claimed is:

1. A canopy, comprising:

a framework including a top covering support having a first outer edge, and a second outer edge spaced from the first outer edge;

a first pair of rod receiving brackets attached to the first outer edge of the covering support;

a second pair of rod receiving brackets attached to the second outer edge of the covering support;

a cover sized to extend over the covering support between the first and second outer edges of the covering support, the cover having a first outer portion and a second outer portion;

a first rod attached to the first outer portion of the cover, the first rod being sized to be selectively received in the first pair of brackets; and a second rod attached to the second outer portion of the cover, the second rod being sized to be selectively received in the second pair of brackets;

wherein each of the first and second pairs of brackets include tensioning mechanisms disposed to operably engage and pull an outer portion of the cover; and wherein the tensioning mechanisms include gears attached to the first and second rods, and wherein each of the first and second pairs of brackets includes a socket and a pawl, each socket being disposed to receive one of the first and second rods, and each pawl being aligned with a gear of one of the first and second rods when the first and second rods are received in the sockets of the first and second pairs of the brackets, thereby forming a ratchet tensioning mechanism.

2. The canopy of claim 1, wherein each of the first and second pairs of brackets include locking mechanisms disposed to engage and secure the first and second rods to the covering support.

3. The canopy of claim 2, wherein each of the locking mechanisms includes a pin disposed to prevent movement of the pawl when the pawl engages the gear of the ratchet tensioning mechanism.

4. The canopy of claim 3, wherein the pin is disposed to extend through aligned openings in the pawl and the bracket.

5. The canopy of claim 1, wherein each of the first and second rods include end portions and in intermediate portion; wherein each end portion includes an outermost flattened surface for receiving a tightening tool, a surface in from the flattened surface for receiving the gears, and a surface in from the gear surface to be received in the bracket sockets; and wherein the cover is attached to the intermediate portion.

6. The canopy of claim 5, wherein the tightening tool is a crank.

7. A method of selectively attaching the cover of the canopy of the claim 5, comprising the steps of:

rolling up the cover on the intermediate portions of the first and second rods;

positioning the cover on the top covering support;

unrolling the cover from the first rod;

attaching the first rod to the first pair of brackets by positioning the rod end portions in the sockets of the first pair of brackets, so that the gears on the first rod are aligned with the pawls on the first pair of brackets, thereby forming the ratchet tensioning mechanisms;

unrolling the cover from the second rod;

attaching the second rod to the second pair of brackets by positioning the rod end portions in the sockets of the second pair of brackets, so that the gears on the second rods are aligned with the pawls on the second pair of brackets, thereby forming the ratchet tensioning mechanisms; and progressively moving the ratchet tensioning mechanism to tighten the cover over the top.

8. The method of claim 7, further including the step of engaging the locking mechanism to retain the tensioning mechanism in a selected position.

9. The method of claim 8, wherein the pin is inserted through the aligned holes in the pawl and the bracket.

* * * * *